US005882780A

United States Patent [19]

Yamamura et al.

[11] Patent Number: 5,882,780

[45] Date of Patent: Mar. 16, 1999

[54] ELASTIC POLYESTER FIBERS AND STRETCHABLE FIBER ARTICLES CONTAINING SAME

[75] Inventors: Yasuo Yamamura; Mikio Tashiro, both of Matsuyama; Yasuyuki Yamazaki, Osaka; Takeshi Honjou, Ibaraki; Nobuyuki Yamamoto, Matsuyama; Michihiro Yamada, Tokuyama, all of Japan

[73] Assignee: Teijin Limited, Osaka, Japan

[21] Appl. No.: 888,103

[22] Filed: Jul. 3, 1997

[30] Foreign Application Priority Data

Jul. 8, 1996 [JP] Japan ..... 8-177891

[51] Int. Cl.[6] ..... D03D 15/08; D01F 6/84; D01F 6/86

[52] U.S. Cl. ..... 428/229; 428/229; 428/231; 428/280; 524/161; 524/166

[58] Field of Search ..... 524/161, 166; 428/227, 231, 229, 280

[56] References Cited

U.S. PATENT DOCUMENTS

| | | | |
|---|---|---|---|
| 4,357,390 | 11/1982 | Ozaki et al. | 428/398 |
| 4,745,142 | 5/1988 | Ohwaki | 524/166 |

FOREIGN PATENT DOCUMENTS

| | | |
|---|---|---|
| 0 159 882 A | 10/1985 | European Pat. Off. . |
| 47-11280 | 4/1972 | Japan . |
| 56-134211 | 10/1981 | Japan . |
| 57-82553 | 5/1982 | Japan . |
| 60-56802 | 12/1985 | Japan . |
| 3-8855 | 1/1991 | Japan . |
| 5-140853 | 6/1993 | Japan . |
| 5-302255 | 11/1993 | Japan . |
| 7-070300A | 3/1995 | Japan . |
| 1 351 898 | 5/1974 | United Kingdom . |

*Primary Examiner*—Patricia A. Short
*Attorney, Agent, or Firm*—Foley & Lardner

[57] ABSTRACT

Elastic polyester fibers having a high anti-cohesive property (separability) include (A) a polyester elastomer and (B) 0.2 to 10%, based on the weight of the elastomer, of an anti-cohesive agent including (a) at least one alkali metal salt of organic sulfonic acid of the formula: $R^1$—$S0_3M$, wherein $R^1$=$C_{5-25}$ hydrocarbon group, M=alkali metal, and (b) at least one compound of the formulae (2)–(6): $R^2$—$X_p$—$CH_2CH_2OH$ (2), $R^3$—COO—$CH_2CH(OH)CH_2OH$ (3), $R^4$—COO—$(CH_2CH_2O)_m$—H (4), $R^5$—O—$(CH_2CH_2O)_n$ H (5) and $R^6$—$CONHCH_2CH_2NHCO$—$R^7$ (6), wherein $R^2$–$R^7$=$C_{5-25}$ hydrocarbon group, X=—CONY or $$-\overset{|}{N}(CH_2CH_2OH)$$

group, p=0 or 1, m, n=5 to 50.

15 Claims, No Drawings

ELASTIC POLYESTER FIBERS AND STRETCHABLE FIBER ARTICLES CONTAINING SAME

BACKGROUND OF THE INVENTION (1) Field of the Invention

The present invention relates to elastic polyester fibers and stretchable fiber articles containing the elastic polyester fibers. More particularly, the present invention relates to elastic polyester fibers which have been produced in a stable condition without occurrence of cohesion of fibers to each other during the fiber production and without generation of static electricity due to contact and abrasion of the fibers with guides and rolls, and which have an excellent smoothness, durable hydrophilicity and stable suspension in water and exhibit a high processability through carding machine and spinning machine, and stretchable fiber articles, for example, nonwoven, woven and knitted fabrics and packing fiber masses comprising the elastic polyester fibers.

(2) Description of Related Art

It is known that conventional elastic fibers made from a polyester elastomer are mostly cohered to each other during fiber-forming and taking up procedures and thus are unsuitable for the use in which the elastic fibers are opened or suspended in water, and the resultant fiber article have many defects derived from the cohered and bundled fibers. Therefore, the resultant fiber article exhibits an unsatisfactory formation, a reduced mechanical strength, elongation and elasticity and a decreased uniformity in the above-mentioned properties.

Also, when used in dry-laid nonwoven fabrics, packing fiber masses or spun yarns, the conventional elastic polyester fibers exhibit a poor processability in carding and spinning procedures due to the high elasticity of the fibers and a high friction between the fibers and guides or rolls, and thus the resultant final product exhibits an undesirable cohesive hand.

Further, the conventional elastic polyester fibers are disadvantageous in that when a plurality of packages of the fibers are stored in accumulated condition, for example, in a storehouse or truck without air-conditioning in summer season, the fibers are mostly cohered to each other.

Several attempts have been made to solve the above-mentioned problems. For example, Japanese Unexamined Patent Publication No. 5-302,255 discloses a core-in-sheath type elastic polyester composite fiber in which a core formed from a polyester elastomer is surrounded by a sheath made from another polyester elastomer containing a reduced amount of soft segments and having a decreased cohesive property. However, when the sheath polyester elastomer has a satisfactorily reduced cohesive property, the resultant core-in-sheath composite fiber exhibits an unsatisfactory elasticity.

Also, Japanese Unexamined Patent Publication No. 57-82,553 and No. 3-8,855 disclose a process for producing elastic filaments from an elastomer, while preventing undesirable cohesion of spun individual filaments with each other by carrying out the filament-forming (spinning) procedure with a reduced number of the individual filaments of 30 or less. This process is, however, unsatisfactory in that the resultant individual filament bundle exhibit an insufficient capability of being opened and the producibility of the elastic filaments is low. Also, when the spun filaments are stored or transported in a raised temperature condition, for example, in the summer season, it is not possible to fully prevent the cohesion of the filaments with each other.

Further, Japanese Unexamined Patent Publication No. 5-140,853 discloses a method of preventing a cohesion phenomenon of elastomer fibers by adding 1 to 10% by weight of a polyolefin and 1 to 8% by weight of fine inorganic particles to the elastomer fibers. However, in this method it is difficult to prevent the cohesion of elastomer fibers with each other, during a fiber-spinning procedure, to a satisfactory extent.

Still further, Japanese Examined Patent Publications No. 47-11,280 and No. 60-56,802 disclose synthetic fibers containing a sulfonic acid metal salt compound mixed in a synthetic resin. In these synthetic fibers, the sulfonic acid metal salt compound is used for the purpose of imparting an antistatic property to the synthetic fibers. In accordance with the research of the inventors of the present invention, when the sulfonic acid metal salt compound alone is incorporated into a polyester elastomer, the resultant polyester elastomer article does not exhibit a sufficient anti-cohesion property.

SUMMARY OF THE INVENTION

An object of the present invention is to provide elastic polyester fibers which have a significantly reduced cohesive property to each other, and thus can be easily opened or separated from each other, and exhibit an excellent hydrophilicity with a high durability and thus can be easily dispersed in an aqueous medium, and stretchable fiber articles comprising the elastic polyester fibers.

The above-mentioned object can be attained by the elastic polyester fibers of the present invention which comprises (A) a polyester elastomer; and (B) 0.2 to 10% by weight, based on the weight of the polyester elastomer (A), of anti-cohesive agent comprising (a) a first component comprising at least one sulfonic acid metal salt of the formula (1):

$$R^1—SO_3M \quad (1)$$

wherein $R^1$ represents a member selected from the group consisting of saturated and unsaturated hydrocarbon groups having 5 to 25 carbon atoms, and M represents an alkali metal atom, and (b) a second component comprising at least one compound selected from those of the formulae (2) to (6):

$$R^2—X_p—CH_2CH_2OH \quad (2)$$

$$R^3—COO—CH_2CH(OH)CH_2OH \quad (3)$$

$$R^4—COO—(CH_2CH_2)_m—H \quad (4)$$

$$R^5—O—(CH_2CH_2O)_n—H \quad (5)$$

and $$R^6—CONHCH_2CH_2NHCOR^7 \quad (6)$$

wherein $R^2$ to $R^7$ respectively and independently from each other represent a saturated and unsaturated aliphatic hydrocarbon group having 5 to 25 carbon atoms, X represents a member selected from the group consisting of a —CONY— group and a $$-\overset{|}{N}(CH_2CH_2OH)$$

group, Y represents a member selected from the group consisting of a hydrogen atom and —$CH_2CH_2OH$ groups, p represents a numeral of 0 or 1, m and n respectively and independently from each other represent an integer of 5 to 50.

The stretchable fiber articles of the present invention comprises a plurality of the elastic polyester fibers as mentioned above.

DESCRIPTION OF THE PREFERRED EMBODIMENTS

The elastic polyester fibers of the present invention comprises a polyester elastomer (A) and an anti-cohesive agent (B) mixed into the polyester elastomer (A).

The elastic polyester elastomer (A) usable for the present invention comprises at least one member selected from elastic block copolyesters comprising hard segments and soft segments copolymerized with each other. The hard segments for the elastic block copolyesters are preferably derived from at least one member selected from the group consisting of polyethylene terephthalate, polybutylene terephthalate, poly-1,4-cyclohexanedimethylene terephthalate, polyethylene naphthalate, and polybutylene naphthalate which are polyesters having a relatively high melting temperature, for example, of 160° to 280° C. The soft segments for the elastic block copolyesters are preferably derived from at least one member selected from the group consisting of aliphatic polyethers, namely poly (alkyleneoxide)glycols, for example, poly(ethyleneoxide) glycols and poly(tetramethyleneoxide)glycols; aliphatic polyesters, for example, polybutylene adipates, polyethylene sebacates; and aromatic polyesters having a relatively low melting temperature of, for example, room temperature or less, preferably 0° C. or less and/or a substantially no crystallizability, for example, polydodecylene isophthalate and polyoctylene isophthalate.

Preferably, the elastic block copolyesters usable for the present invention are selected from polyetherester block copolymers having soft segments derived from poly (alkyleneoxide)glycols wherein the alkylene group has 2 to 4 carbon atoms.

In a preferable embodiment of the elastic polyester fibers of the present invention, the polyetherester block copolymer is a copolymerization product of a dicarboxylic acid component comprising terephthalic acid in a content of 50 molar % or more, more preferably 80 molar % or more, still more preferably 90 molar % or more, based on the total molar amount the dicarboxylic acid component; a monomeric glycol component comprising 1,4-butanediol in a content of 80 molar % or more, more preferably 90 molar % or more, based on the total molar amount of the monomeric glycol component; and a poly(alkyleneoxide)glycol component having an average molecular weight of 400 to 4000. Preferably, the alkylene group of the poly(alkyleneoxide) glycol component has 2 to 4 carbon atoms.

In the dicarboxylic acid component of the polyetherester block copolymer, the other dicarboxylic acids which may be contained in a content of 50 molar % or less in addition to terephthalic acid include other aromatic dicarboxylic acids, for example, Isophthalic acid, phthalic acid, 2,6-naphthalenedicarboxylic acid, bis(p-carboxyphenyl) methane and 4,4'-diphenyletherdicarboxylic acid; aliphatic dicarboxylic acids, for example, adipic acid, sebacic acid and dodecanoic diacid; and cycloaliphatic dicarboxylic acids, for example, 1,4-cyclohexanedicarboxylic acid. Especially, isophthalic acid is more preferred.

In the monomeric glycol component, the other monomeric glycol compounds which may be contained in a content of 20 molar % or less in addition to 1,4-butanediol, include ethyleneglycol, 1,3-propanediol, 1,5-pentanediol, 1,6-hexanediol, diethyleneglycol, 1,4-cyclohexanediol and 1,4-cyclohexanedimethanol.

The poly(alkyleneoxide)glycol component preferably comprises at least one member selected from polyethyleneglycol, poly(propyleneoxide)glycol and poly (tetramethyleneoxide)glycol, more preferably poly (tetramethyleneoxide)glycol having an average molecular weight of 1000 to 3000.

In the polyester elastomer usable for the present invention, the soft segments, namely, the (alkyleneoxide) glycol units are preferably in a content of 30 to 80% by weight, more preferably 50 to 70% by weight. If the soft segment content is less than 30% by weight, the resultant elastic polyester fibers may exhibit an unsatisfactory stretchability. Also, if the soft segment content is more than 80% by weight, the resultant polyester elastomer may exhibit a poor crystallizability and thus is difficult to melt-spin, and the resultant polyester elastic fibers may exhibit an unsatisfactory stretchability.

Also, the polyetherester block copolymers usable for the polyester elastomer (A) preferably exhibit an intrinsic viscosity of 1.0 to 3.0, more preferably 1.3 to 2.0, determined in a solvent consisting of orthochlorophenol at a temperature of 30° C. Further, the polyetherester block copolymers preferably have a melting temperature of 130° C. to 200° C. Such copolymers can be smoothly processed with a satisfactory stability, and the resultant fiber article can exhibit satisfactory thermal performances.

The polyester elastomer (A) optionally contains a small amount, for example, 10% by weight or less, of an additive comprising at least one of coloring materials, antioxidants, heat-resisting agents and delustering agents.

The anti-cohesive component (B) comprises a first component (a) comprising at least one sulfonic acid metal salt of the formula (1):

$$R^1—SO_3M \quad (1)$$

and a second component (b) comprising at least one compound selected from the formulae (2) to (6):

$$R^2—X_p—CH_2CH_2OH \quad (2)$$

$$R^3—COO—CH_2CH(OH)CH_2OH \quad (3)$$

$$R^4—COO—(CH_2CH_2O)_mH \quad (4)$$

$$R^5—O—(CH_2CH_2O)_n—H \quad (5)$$

and $$R^6—CONHCH_2CH_2NHCOR^7 \quad (6)$$

The second component (b) contributes to cause the sulfonic acid metal salt of the formula (1) to be uniformly dispersed in the polyester elastomer (A), and to impart an excellent anti-cohesive property to the resultant elastic polyester fibers.

In the formula (1), $R^1$ represents a member selected from saturated and unsaturated hydrocarbon groups having 5 to 25 carbon atoms, preferably 8 to 20 carbon atoms, and M represents an alkali metal atom, for example, a sodium or potassium atom. The hydrocarbon groups represented by R include straight and branched chain alkyl and alkenyl groups, for example, octyl, decyl, lauryl, oleyl and stearyl groups, aryl groups, for example, phenyl group, and alkylaryl and alkenylaryl groups, wherein the alkyl and alkenyl groups may be in straight chain or branched chain, for example, tolyl, 4-dodecylphenyl and dibutylnaphthyl groups.

If the $R^1$ group has less than 5 carbon atoms, the resultant elastic polyester fibers exhibit an unsatisfactory anti-cohesive property. If the carbon atom number of the $R^1$ group is more than 25, the resultant sulfonic acid metal salt of the formula (1) exhibits an unsatisfactory solubility in, or compatibility with, the polyester elastomer (A).

The sulfonic acid metal salt of the formula (1) usable for the present invention is preferably selected from sodium alkylsulfonate having 15 carbon atoms on average, sodium decanesulfonate, sodium laurylsulfonate, disodium decanedisulfonate, sodium dodecylbenzenesulfonate, and potassium dibutylnaphthalenesulfonate.

In the formulae (2) to (6), $R^2$ to $R^7$ represent, respectively and independently from each other, a saturated and unsaturated aliphatic hydrocarbon group having 5 to 25 carbon atoms, preferably 8 to 18 carbon atoms. The aliphatic hydrocarbon group is in a straight chain or branched chain form. Preferably, the aliphatic hydrocarbon group represented by $R^2$ to $R^7$ is selected from octyl, decyl, lauryl, myristyl and stearyl groups.

If the hydrocarbon groups represented by $R^2$ to $R^7$ have less than 5 carbon atoms or more than 25 carbon atoms, the resultant compounds cannot cause the sulfonic acid metal salt of the formula (1) to be fully dispersed in the polyester elastomer (A), and thus the resultant elastic polyester fibers to exhibit an unsatisfactory anti-cohesive property.

In the formula (2), X represents a member selected from the group consisting of a —CONY— group and a $$-\overset{|}{N}(CH_2CH_2OH)$$

group, Y represents a member selected from the group consisting of a hydrogen atom and $—CH_2CH_2OH$ group and p represents a numeral of 0 or 1.

The compound of the formula (2) is preferably selected from fatty acid monoethanol amides (p=1, X=—CONH—), fatty acid diethanol amides (p=1, $$X = -\overset{|}{C}ON(CH_2CH_2OH)),$$

fatty diethanol amines (p=1, $$X = -\overset{|}{N}(CH_2CH_2OH))$$

and fatty alcohols (p=0), for example, lauroylmonoethanolamide, stearoylmonoethanolamide, lauroyldiethanolamide, stearoyldiethanolamide, lauryldiethanolamine, stearyldiethanolamine and stearyl alcohol.

The compound of the formula (3) is preferably selected from glycerol esters of fatty acids, for example, glycerol monostearic esters, glycerol monolauric esters and glycerol monododecanates.

In the formulae (4) and (5), m and n respectively and independently from each other, represent an integer of 5 to 50, preferably 7 to 30.

The compound of the formula (4) is preferably selected from polyethyleneglycol esters of fatty acids, for example, polyethyleneglycol monostearic esters, polyethyleneglycol monolauric esters and polyethyleneglycol monododecanates.

The compound of the formula (5) is preferably selected from aliphatic hydrocarbon ethers of polyethyleneglycols, for example, polyethyleneglycol monostearylethers, polyethyleneglycol monolauryl ethers and polyethyleneglycol monodecyl ethers.

The compound of the formula (6) is preferably selected from ethylene-bis-fatty acid amides, for example, ethylene-bis-stearoylamide, ethylene-bis-lauroylamide and ethylene-bis-decanoylamide.

In the anti-cohesive agent (B) usable for the present invention, the first component (a) and the second component (b) are preferably present in a mixing weight ratio (a/b) of 95/5 to 50/50, more preferably 90/10 to 60/40. If the ratio (a/b) is more than 95/5, it may be difficult to uniformly disperse the first component (a) in the polyester elastomer (A) and thus the resultant elastic polyester fibers may exhibit an unsatisfactory anti-cohesive property. Also, if the ratio (a/b) is less than 50/50, the resultant polyester elastomer mixture may exhibit a reduced thermal stability and thus a degraded spinnability.

In the anti-cohesive agent (B) of the present invention, the specific compound of the formulae (2) to (6) is mixed in the sulfonic acid metal salt of the formula (1). Therefore, the anti-cohesive agent (B) exhibits an appropriate bleeding property and thus can migrate from the inside to the surface portion of the individual fiber at an appropriate rate. Therefore, the anti-cohesive agent (B) of the present invention can be distributed in an increased concentration in the surface portion. Namely, even when a portion of the anti-cohesive agent (B) located in the surface portion of the fiber is removed by laundering or cleaning, the remaining portion of the anti-cohesive agent (B) can migrate from the inside to the surface portion so as to keep the concentration of the anti-cohesive agent (B) in the surface portion constant. Accordingly, the surfaces of the elastic polyester fibers of the present invention exhibit high anti-cohesive property and hydrophilicity with a high durability over a long period of time.

In the elastic polyester fibers of the present invention, the anti-cohesive agent (B) is contained in an amount of 0.2 to 10% by weight, preferably 2 to 5% by weight, based on the weight of the polyester elastomer component (A). If the content of the anti-cohesive agent is less than 0.2% by weight, the resultant elastic polyester fibers exhibit an unsatisfactory anti-cohesive property such that the resultant elastic fibers cannot be smoothly opened or separated from each other and an insufficient smoothness and hydrophilicity of the fiber surfaces such that the resultant elastic fiber cannot be evenly dispersed in an aqueous medium. Also, if the content is more than 10% by weight, the resultant polyester elastomer mixture exhibits a reduced stability in spinning procedure and the resultant elastic fibers are mostly broken due to formation of scum accumulated on guides or rollers. Also, the resultant elastic fibers exhibit a reduced hydrophilicity and are difficult to evenly disperse in an aqueous medium.

There is no limitation to the process for incorporating the anti-cohesive agent (B) into the polyester elastomer (A). Namely, the elastic polyester fibers of the present invention can be produced by a conventional fiber-producing method. For example, in the production of the elastic polyester fibers of the present invention, a first component (a) comprising at least one sulfonic acid metal salt of the formula (1) is mixed with a second component (b) comprising at least one compound of the formulae (2) to (6); the resultant anti-cohesive agent (B) is melt-mixed with a polyester elastomer (A) to provide master pellets; the master pellets are melt-mixed with an additional amount of pellets of the polyester elastomer (A); and the resultant melt is subjected to a melt-spinning procedure. In another process, an anti-cohesive agent (B) comprising the sulfonic acid metal salt component (a) and the compound component (b) is added to an inorganic additive, for example, magnesium stearate; the resultant mixture is pelletized; the pellets are blended with pellets of a polyester elastomer (A); and the resultant pellet mixture is subjected to a melt-spinning procedure. In still another process, the anti-cohesive agent (B) comprising the sulfonic acid metal salt component (a) and the compound component (b) is melt-mixed with a polyester elastomer (A), and the resultant melt is subjected to a melt-spinning procedure.

In the melt-spinning procedure, the polyester elastomer (A) mixed with the anti-cohesive agent (B) is melt-spun by a conventional melt-spinning apparatus for fiber production. The spinning temperature is preferably 30° C. to 80° C. above the melting temperature of the polyester elastomer (A). There is no limitation to the taking up speed of the spun filaments. Usually, the taking up speed is preferably 100 to 2000 m/minute. The taken up, undrawn filaments are drawn at a desired draw ratio at a temperature of from room temperature to 100° C., and then heat treated at a temperature of 80° C. to 120° C., under a dry relaxing condition under which the filaments are allowed to shrink at a shrinkage of 15 to 40%. The undrawn filaments may be directly subjected to the heat-treatment, without the drawing procedure.

The dry heat-treated elastic polyester fibers of the present invention exhibit a dry heat shrinkage of 40% or less at a temperature of 120° C. and a high elastic recovery.

In the elastic polyester fibers of the present invention, there is no limitation to cross-sectional profile, thickness and length of individual fibers and the fibers can be designed in response to a requirement in use. The elastic polyester fibers of the present invention may be in the form of staple fibers or of continuous filaments, which may be crimped or not crimped.

Since the anti-cohesive agent is contained, the elastic polyester fibers of the present invention can be heat treated at a higher temperature, for example, 5° to 20° C. than that for conventional elastic polyester fibers and thus the heat-treated elastic polyester fibers of the present invention exhibit a lower thermal shrinkage, for example, 40% or less, preferably 30% or less, still more preferably 20% or less, at a temperature of 120° C. Therefore, the fiber articles prepared from the heat-treated elastic polyester fibers of the present invention exhibit an enhanced stretchability and dimensional stability in comparison with the conventional elastic polyester fibers.

The elastic polyester fibers of the present invention are usable for producing various types of fiber articles, for example, stretchable nonwoven fabrics, stretchable packing fiber masses and stretchable woven and knitted fabrics. When the elastic polyester fibers are used for the above-mentioned uses, the surfaces of the elastic polyester fibers are optionally coated with a polymeric material, for example, a polyester resin dispersible or soluble in water, in an amount of 0.1 to 2.0% by weight, preferably 0.2 to 1.0% by weight, based on the weight of the fibers. The water-dispersible or soluble polyester resin has a high compatibility or affinity with the anti-cohesive agent and thus the coated elastic polyester fibers with the water-dispersible polyester resin exhibit a high hydrophilicity and durability and can be evenly dispersed in water. The resultant aqueous slurry of the coated elastic polyester fiber has a high stability and is useful for producing a wet-laid nonwoven fabric therefrom.

The water-dispersible or soluble polyester resin is usually produced by copolymerizing a dicarboxylic acid component, a glycol component and an additional hydrophilic component comprising a compound having a hydrophilic functional group which contribute to enhancing the dispersibility or solubility of the resultant resin in water.

Preferably, the water-dispersible or soluble copolyester resin is selected from copolyesters of a dicarboxylic acid component comprising terephthalic acid and isophthalic acid in a molar mixing ratio of 95/5 to 50/50, with a glycol component comprising ethylene glycol and/or diethylene glycol, and an additional hydrophilic component comprising 30 to 90% by weight, based on the total weight of the copolyester, of a polyethyleneglycol having an average molecular weight of 600 to 6,000, and optionally 20 molar % or less of 5-sodium-sulfoisophthalic acid based on the total molar amount of the copolyester resin. The copolyesters are polyethyleneterephthalate-polyethyleneglycol copolyesters.

The stretchable nonwoven fabrics include stretchable wet-laid and dry-laid nonwoven fabrics. The wet-laid nonwoven fabric is produced by a paper-forming wet method in which the elastic polyester fibers in the form of staple fibers are suspended in an aqueous slurry, the aqueous slurry is subjected to the paper-forming procedure, and the resultant wet fiber sheet is press-dried at an elevated temperature of, preferably 110° to 160° C. When the elastic polyester fibers are pressed against each other at the elevated temperature, the fibers are lightly cohered at intersecting points to each other, to form a nonwoven fabric.

When the elastic polyester fibers of the present invention are used for the wet-laid nonwoven fabric, the elastic polyester fibers are in the form of staple fibers, and preferably have a thickness of 0.11 to 22.22 dtex (0.1 to 20.0 denier) and a fiber length of 2 to 25 mm. A fiber thickness less than 0.11 dtex (0.1 denier) may cause a poor productivity of such fine staple fibers. Also, a fiber thickness more than 22.22 dtex (20.0 denier) may cause a difficulty in production of the nonwoven fabric because the number of the staple fibers allowed to be present in the resultant nonwoven fabric is decreased, and may result in a degraded formation and reduced mechanical strength and elongation of the resulting nonwoven fabric.

If the fiber length falls outside of the range of from 2 to 25 mm, it may be difficult to fully intertwine the resultant staple fibers with each other and to be smoothly form into a nonwoven fabric, and the resultant nonwoven fabric may exhibit unsatisfactory tear strength, tensile strength and elongation.

The elastic polyester fibers for the wet-Laid nonwoven fabric preferably have substantially no crimps, to enhance the dispersibility of the fibers in water. However, since the elastic polyester fibers of the present invention contain the anti-cohesive agent and have an enhanced sleekness, the fibers may have a small number of crimps. Usually, as long as the number of crimps is 8 crimps/25 mm or less, the resultant elastic staple fibers can be converted to a wet-laid woven fabric without difficulty.

The production of the wet-laid nonwoven fabric from the elastic polyester fibers of the present invention can be effected by a conventional wet paper-forming method. For example, the elastic polyester staple fibers are uniformed dispersed or suspended in an aqueous medium, and the resultant aqueous slurry is subjected to the paper-forming procedure. The aqueous slurry optionally contains a binder which can be selected from those usable for the usual paper-forming procedure. Also, the resultant wet nonwoven web is optionally subjected to a fiber-intertwining procedure by water-jet streams. For example, the wet (non-dried) fiber web produced by the paper-forming procedure is carried on a net having a 100 or less mesh size, a plurality of high pressure water jet streams are spouted toward one surface of the web through a plurality of nozzles having an opening size of 0.2 mm under a pressure of 10 to 40 kg/cm$^2$, preferably 15 to 25 kg/cm$^2$, while applying a sucking treatment to the opposite surface of the web under a reduced pressure or vacuum to remove water from the web, and further a plurality of high pressure water jet streams are spouted toward the same surface of the web as mentioned above through a plurality of nozzles having an opening size of 0.1 mm under a pressure of 30 to 100 kg/cm$^2$, preferably 40 to 60 kg/cm, while applying a sucking treatment to the opposite surface of the web under a reduced pressure or vacuum to remove water from the web, and optionally the further water jet treatment is repeated twice or more. The above-mentioned procedures are applied to the opposite surface of the web. The water jet-treated web is further dehydrated by suction and roller-squeezing and then dried at an elevated temperature of, for example, 110° to 200° C. by a drum dryer or hot air dryer, to lightly cohere the elastic fibers at intersecting points thereof to each other and to form a nonwoven fabric.

The wet fiber sheet-forming procedure and the water jet intertwining procedure may be carried out continuously or separately. If these procedures are carried out separately from each other, the wet fiber web prepared by the wet fiber sheet-forming procedure must be dried and wound up. In this case, for the purpose of enhancing the handling property of the web, the elastic polyester staple fibers are preferably blended with a small amount, for example, 1 to 10% by weight, more preferably 3 to 5% by weight, based on the weight of the elastic polyester fibers, of hot water-soluble binder staple fibers, for example, polyvinyl alcohol staple fibers. After the nonwoven fabric is completely produced, the binder fibers can be dissolved and removed by treating the nonwoven fabric with hot water at a temperature of 80° to 90° C. Thus the resultant nonwoven fabric is free from the binder fibers and exhibits a satisfactory elasticity. The binder fibers preferably have the similar fiber thickness and length to those of the elastic polyester staple fibers, to provide a final wet-laid nonwoven fabric having a uniform formation.

The dried staple fiber web derived from the wet fiber web-forming procedure may be locally heat-pressed by using an embossing rollers, without applying the water jet intertwining procedure. For example, the web is passed through a pair of embossing rollers or a combination of an embossing roller and a flat roller under pressure. The heat pressing temperature is varied in response to the type of the polyester elastomer in the fibers. Usually, the heat-pressing procedure is carried out at a temperature of at least 5° C. below the melting temperature of the polyester elastomer. The total of the areas in which the web is locally heat-pressed and the elastic polyester fibers are cohered to each other, is preferably 4 to 20% of the entire area of the web.

The stretchable wet-laid nonwoven fabric prepared as mentioned above preferably has a basis weight of 10 to 300 g/m$^2$, more preferably 20 to 200 g/m$^2$, still more preferably 50 to 100 g/m$^2$ and an ultimate elongation at break of 150 to 500%, more preferably 300 to 450%.

When the elastic polyester fibers of the present invention are in the form of staple fibers and are used for the production of dry-laid nonwoven fabrics, woven and knitted fabrics and packing fiber masses, preferably the elastic polyester fibers have a thickness of 0.11 to 222.22 dtex (0.1 to 200 denier), more preferably 2.22 to 111.11 dtex (2 to 100 denier) and a fiber length of 30 to 200 mm. Also, the elastic polyester staple fibers preferably have a number of crimps of 6 to 25 crimps/25 mm and a percentage crimp of 6 to 30%. There is no limitation to the form of the crims and the crimp-forming means. Usually, the crimps are two-dimensional crimps or three-dimensional crimps, preferably three-dimensional crimps.

The elastic polyester fibers of the present invention may be in the form of continuous filaments and can be used for the production of stretchable continuous filament nonwoven fabrics. In this case, the elastic polyester filaments preferably have an individual filament thickness of 1.11 to 11.11 dtex (1.0 to 10.0 denier). There is no specific limitation to the basis weight of the nonwoven fabrics. The basis weight is varied in response to the desired use of the nonwoven fabric. Usually, the basis weight is designed preferably in the range of from 10 to 100 g/m$^2$.

The elastic polyester filament nonwoven fabric can be produced, for example, by the following procedures.

A blend of the polyester elastomer (A) with the anti-cohesive agent (B) is melt spun by a melt-spinning apparatus for filament formation, a bundle of the spun filaments is drafted by a high pressure air jet apparatus such as an ejector, the drafted filament bundle is opened by a filament opening machine such as hopper feeder, the opened filaments are evenly accumulated on a filament-collecting face, for example, a net, which moves in a direction to form a filament web having a desired thickness and basis weight. In the production of the filaments and the web, the melt-spinning nozzles and the ejector can have a desired form. However, if the ejector has an circular opening, sometimes the extruded filaments are bundled at a narrow portion such as diffuser portion so as to reduce the opening property thereof. Therefore, the opening of the ejector preferably has a rectangular form. Also, the spinning nozzles preferably have a rectangular opening similar to that of the ejector.

The resultant filament web is subjected to a local heat-pressing procedure using embossing rollers by which the heat pressed portions of the filaments are cohered to each other, or to a high pressure water jet treatment by which the filaments are intertwined with each other, to form a nonwoven fabric. In the local heat-pressing procedure, the filament web is passed through a pair of embossing rollers or a combination of an embossing roller and a flat roller. The heat-pressing temperature is variable in response to the type of the polyester elastomer. Usually, the heat-pressing temperature is established in the level of at least 5° C. below the melting temperature of the polyester elastomer. The total of the heat-pressed areas of the filament web preferably corresponds to 4 to 20% of the entire area of the web. If the total heat-pressed area is less than 4%, the resultant nonwoven fabric may be difficult to keep the form of the fabric because the individual filaments can be easily separated from each other. Also, if the total heat-pressed area is more than 20%, the resultant nonwoven fabric may exhibit an insufficient stretchability.

In the high pressure water jet intertwining treatment, the individual filaments are intertwined with each other by a plurality of high pressure water jet streams spouted through a plurality of thin nozzles under a pressure of, for example, 10 to 200 kg/cm$^2$.

The resultant filament nonwoven fabric of the present invention exhibits a high 50% elastic recovery of stretch of 70% or more, a good draping property and an excellent hand.

EXAMPLES

The present invention will be further illustrated by the following examples.

In the examples, the following tests were carried out.

(1) Anti-cohesive property

The anti-cohesive property of the elastic polyester fibers was evaluated regarding touch and fiber-opening properties into the following classes.

| Class | Hand and opening property |
|---|---|
| 3 | A bundle of fibers or filaments exhibited a dry and sleek touch and could be easily and completely opened. |
| 2 | A fiber or filament bundle exhibited a slightly stiff touch and a portion of the bundle could not be opened. |
| 1 | A fiber or filament bundle is stiff and could not be opened. |

(2) Dispersibility in water

A graduated cylinder having a capacity of 500 ml was charged with 100 ml of water, 0.5 g of fibers cut into a desired length was entered into the cylinder, the top opening of the cylinder is closed by a lid, and the cylinder was vigorously shaken up and down 5 times, then the presence of bundles fibers in water is checked by naked eye. The results are evaluated as follows.

| Class | The number of fiber bundles found in cylinder |
|---|---|
| 3 | 4 or less |
| 2 | 5 to 20 |
| 1 | 21 or more |

(3) Tensile strength and ultimate elongation of nonwoven fabric

Tensile strength and ultimate elongation of nonwoven fabric were measured in longitudinal and transverse directions by using a constant stretch type tensile tester and an average value was calculated.

(4) Dry thermal shrinkage

Fibers or filaments were heated in hot air at a temperature of 120° C. for 20 minutes, and the resultant thermal shrinkage of the fibers or filaments was measured.

(5) Formation (appearance) of nonwoven fabric

An evenness in appearance of nonwoven fabric was organoleptically evaluated by naked eye observation as follows.

| Class | Appearance |
|---|---|
| 3 | Substantially no unevenness |
| 2 | Slightly uneven<br>Substantially no difficulty in practical use |
| 1 | Very uneven |

(6) Elastic recovery of stretch

Specimens having a width of 5 cm, and a length of 10 cm were taken from a nonwoven fabric, stretched at a stretching rate of 10 cm/minute to an elongation of 20%, and relaxed at a relaxing rate of 10 cm/minute to an elongation of 0%. After the relaxing step, the length L of the specimen was measured.

A 20% elastic recovery of stretch was calculated in accordance with the following equation:

$$20\% \text{ Elastic recovery of stretch } (\%)=100-[100\times(L-10)/2]$$

A 50% elastic recovery of stretch was measured in the same manner as mentioned above, except that the stretching step is carried out to an elongation of 50%, and calculated in accordance with the following equation:

$$50\% \text{ Elastic recovery of stretch } (\%)=100-[100\times(L-10)/5]$$

(7) Fiber-separating property

A plurality of melt-extruded filaments were opened by ejector and accumulated to form a filament web. Specimens having dimensions of 3 cm×3 cm were taken from the filament web. The number of filament bundles consisting of 10 or more filaments in each specimen was counted. When the filament bundle number is 5 or less, the filaments were evaluated as good in fiber-separating property.

(8) Melt-spinnability

During a melt-spinning procedure, breakages of filaments was counted, and evaluated as follows.

| Class | Occurrence of filament breakage |
|---|---|
| 3 | No occurrence of filament breakage over a time of more than 8 hours |
| 2 | No occurrence of filament breakage for a time of 1 to 8 hours |
| 1 | Filament breakage occurred once or more within one hour |

Example 1

A polyetherester block copolymer (polyester elastomer) was prepared by copolymerizing a terephthalic acid component, a tetramethyleneglycol component and a poly (tetramethyleneoxide)glycol component having an average molecular weight of 2000. The resultant copolymer had an intrinsic viscosity of 1.35 determined in o-chlorophenol at a temperature of 30° C. and a content of the poly (tetramethyleneoxide)glycol component of about 60% by weight.

The polyetherester block copolymer was melt-mixed with 2% by weight, based on the weight of the copolymer, of an anti-cohesive agent consisting of 60% by weight of sodium alkylsulfonates having 15 carbon atoms in average and 40% by weight of lauroylmonoethanolamide, by using a melt-extruder at a temperature of 200° C. The resultant melt of the mixture was extruded through a spinneret having 1200 spinning orifices with an inside diameter of 0.3 mm. The extruded filaments were cooled and taken up at a taking-up speed of 1800 m/minute under draft, while coating the filament peripheries with 0.3% by weight, based on the weight of the filaments, of a water-dispersible polyester resin, to provide undrawn filaments having an individual filament thickness of 1.67 dtex (1.5 denier). The water-dispersible polyester resin is a copolymerization product of terephthalic acid, isophthalic acid, ethyleneglycol, and a polyethyleneglycol having an average molecular weight of 2000, and had a molar ratio of terephthalic acid to isophthalic acid of 7/3 and a content of the polyethyleneglycol of about 50% by weight.

The undrawn filaments were cut into a length of 10 mm to provide staple fibers.

The resultant staple fibers were dispersed in water by using a fiber disperser to provide an aqueous slurry having a fiber consistency of 0.01% by weight. The fiber slurry was subjected to a wet fiber sheet-forming procedure by using a TAPPI paper-forming machine. The fiber slurry contained 1g of a thickening agent consisting of carboxymethyl cellulose per kg of the fiber, to improve the formation of the resultant sheet. The wet sheet was dried by using a paper dryer at a temperature of 145° C. at which the staple fibers were lightly cohered to each other to form a nonwoven fabric.

The resultant wet laid nonwoven fabric had a basis weight of 80 g/m$^2$, a thickness of 0.080 mm, a dry tensile strength of 0.9 kg/15 mm and an ultimate elongation of 42%. Also, the nonwoven fabric had an excellent elastic recovery of stretch.

When the nonwoven fabric was employed to pack an article, no noise was generated and no wrinkle was formed on the nonwoven fabric. The nonwoven fabric had a soft hand.

The test results are shown in Table 1.

Examples 2 to 10 and Comparative Examples 1 to 4

In each of Examples 2 to 10 and Comparative Examples 1 to 4, elastic polyester staple fibers and a wet-laid nonwoven fabric were produced by the same procedures as in Example 1 except that the composition and applied amount of the anti-cohesive agent, the thickness and length of the resultant individual elastic polyester staple fibers were as shown in Table 1.

The test results are shown in Table 1.

The resultant wet-laid nonwoven fabric had a basis weight of 83 g/m$^2$, a thickness of 0.085 mm, a dry tensile strength of 1.0 kg/15 mm, an ultimate elongation of 45% and a 20% elastic recovery of stretch of 90%. This woven fabric exhibited an excellent stretch recovery property, a soft hand and a good formation.

Example 12

Elastic polyester staple fibers and a wet-laid nonwoven fabric were produced by the same procedures as in Example 1, except that lauroylmonoethanolamide for the anti-cohesive agent was replaced by diethanolstearylamine. The resultant wet-laid nonwoven fabric had a basis weight of 81 g/m$^2$, a thickness of 0.082 mm, a dry tensile strength of 0.9 kg/15 mm, an ultimate elongation of 43% and a 20% elastic recovery of stretch of 89%.

This nonwoven fabric exhibited an excellent stretch recovery performance, a soft hand and a good formation.

Example 13

Elastic polyester staple fibers and a wet-laid nonwoven fabric were produced by the same procedures as in Example 1, except that lauroylmonoethanolamide for the anti-cohesive agent was replaced by ethylene-bisstearoylamide. The resultant wet-laid nonwoven fabric had a basis weight of 100 g/m$^2$, a thickness of 0.250 mm, a dry tensile strength of 0.2 kg/15 mm, an ultimate elongation of 70% and a 20% elastic recovery of stretch of 92%.

This nonwoven fabric exhibited an excellent stretch recovery performance, a soft hand and a good formation.

In a comparison of Examples 1 to 13 with Comparative Examples 1 to 4, it is clear that the elastic polyester fibers of the present invention exhibit a high separability from each other and thus can be evenly dispersed in water, and are useful for the production nonwoven fabrics, especially wet-laid nonwoven fabrics having excellent elastic performance and good hand and formation.

TABLE 1

| | | Item | | | | | | | | | | | |
|---|---|---|---|---|---|---|---|---|---|---|---|---|---|
| | | Anti-cohesive agent | | | | | | | | Wet-laid nonwoven fabric | | | |
| | | Composition wt % | | | Thickness | | Thermal | | | | | | 20% Elastic |
| Example No. | | First component (a) | Second component (b) | Content (wt %) | of individual fibers (dtex) | Length of individual fibers (mm) | shrinkage at 120° C. (%) | Anti-cohesive property | Dispersibility in water | Tensile strength (kg/15 mm) | Ultimate elongation (%) | Formation (Appearance) | recovery of stretch (%) |
| Example | 1 | 60 | 40 | 2.0 | 1.67 | 10 | 30 | 3 | 3 | 0.9 | 42 | 3 | 92 |
| | 2 | 90 | 10 | 2.0 | 1.67 | 10 | 25 | 3 | 2 | 1.0 | 44 | 2 | 90 |
| | 3 | 40 | 60 | 2.0 | 1.67 | 10 | 28 | 3 | 2 | 0.8 | 45 | 2 | 92 |
| Comparative | 1 | — | — | — | 1.67 | 10 | 32 | 1 | 1 | 0.2 | 25 | 1 | 90 |
| | 2 | 100 | — | 2.0 | 1.67 | 10 | 29 | 2 | 1 | 0.4 | 32 | 1 | 90 |
| Example | 3 | — | 100 | 2.0 | 1.67 | 10 | 35 | 2 | 1 | 0.3 | 30 | 1 | 91 |
| Example | 4 | 60 | 40 | 5.0 | 1.67 | 10 | 30 | 3 | 3 | 1.0 | 43 | 3 | 90 |
| | 5 | 60 | 40 | 8.0 | 1.67 | 10 | 31 | 3 | 3 | 0.8 | 46 | 3 | 90 |
| Comparative Example | 4 | 60 | 40 | 12.0 | 1.67 | 1.0 | 29 | 3 | 1 | 0.4 | 33 | 1 | 90 |
| Example | 6 | 60 | 40 | 2.0 | 0.56 | 10 | 20 | 3 | 2 | 0.7 | 44 | 2 | 85 |
| | 7 | 60 | 40 | 2.0 | 5.56 | 10 | 35 | 3 | 3 | 0.7 | 43 | 3 | 93 |
| | 8 | 60 | 40 | 2.0 | 16.67 | 10 | 40 | 3 | 3 | 0.6 | 40 | 3 | 95 |
| | 9 | 60 | 40 | 2.0 | 1.67 | 20 | 30 | 3 | 2 | 0.7 | 42 | 2 | 90 |
| | 10 | 60 | 40 | 2.0 | 1.67 | 5 | 29 | 3 | 1 | 0.7 | 42 | 3 | 90 |

Example 11

Elastic polyester staple fibers and a wet-laid nonwoven fabric were produced by the same procedures as in Example 1, except that sodium alkylsulfonate for the anti-cohesive agent was replaced by sodium dodecylbenzenesulfonate.

Example 14

A polyetherester block copolymer was prepared by copolymerizing 170 parts by weight of dimethyl terephthalate, 100 parts by weight of tetramethyleneglycol and 280 parts by weight of a poly(tetramethyleneoxide)glycol having a molecular weight of 2000. The resultant copolymer had an intrinsic viscosity of 1.35 determined by the same manner as in Example 1 and a poly(tetramethyleneoxide)glycol content of about 60% by weight.

The polyetherester block copolymer was melt-mixed with 2.0% by weight, based on the weight of the copolymer, of an anti-cohesive agent consisting of 80% by weight of sodium alkylsulfonates having 15 carbon atoms in average and 20 parts by weight of stearoylmonoethanolamide. The resultant melt was extruded through a spinneret having 50 spinning orifices with an inside diameter of 0.4 mm at a temperature of 220° C., while drafting by using an ejector, the resultant filaments were opened by a filament-opening machine, the opened filaments were accumulated on a conveyer net to form a filament web. In the filament web, the individual filaments had a thickness of 3.33 dtex (3.0 denier). The filament web was subjected to an embossing procedure using a pair of embossing rollers at a temperature of 170° C., to locally cohere the filaments to each other and to provide a nonwoven filament fabric with a basis weight of 60 g/m$^2$.

The test results are shown in Table 2.

Comparative Example 5

A nonwoven filament fabric was produced by the same procedures as in Example 14, except that an anti-cohesive agent consisting of the same alkylsulfonic acid sodium salts as in Example 14 alone was used.

The embossed nonwoven filament fabric had a basis weight of 60 g/m$^2$.

The test results are shown in Table 2.

Comparative Example 6

A nonwoven filament fabric was produced by the same procedures as in Example 14, except that an anti-cohesive agent consisting of the same stearoylmonoethanolamide as in Example 14 alone was used.

The embossed nonwoven filament fabric had a basis weight of 60 g/m$^2$.

The test results are shown in Table 2.

Comparative Example 7

A nonwoven filament fabric was produced by the same procedures as in Example 14, except that the same anti-cohesive agent as in Example 14 was used in an amount of 12% by weight based on the weight of the polyetherester block copolymer.

The embossed nonwoven filament fabric had a basis weight of 60 g/m$^2$.

The test results are shown in Table 2.

TABLE 2

| | Item | | |
|---|---|---|---|
| Example No. | Fiber-separating property (The number of filament bundles) | Melt spinnability | 50% Elastic recovery of stretch (%) |
| Example 14 | 3 | 3 | 85 |
| Comparative Example | | | |
| 5 | 13 | 3 | 82 |
| 6 | 5 | 1 | 87 |
| 7 | 2 | 1 | 75 |

Table 2 shows that the mixture of the polyester elastomer (A) with the anti-cohesive agent (B) exhibits a satisfactory melt-spinnability and the resultant elastic polyester filaments had a high opening and separating property and an excellent elastic recovery of stretch.

What we claim is:

1. Elastic polyester fibers comprising:

(A) a polyester elastomer which comprises at least one member selected from elastic block copolyesters comprising (i) hard segments derived from at least one member selected from the group consisting of polyethelene terephthalate, polybutylene terephthalate, poly-1,4-cyclohexanedimethylene terephthalate, polyethylene naphthalate, and polybutylene naphthalate, and (ii) soft segments derived from at least one member selected from the group consisting of aliphatic polyethers, aliphatic polyesters and aromatic polyesters having a low melting temperature and/or substantially no crystallizability, the soft segments (ii) being present in an amount of 30 to 80% by weight based on the weight of the elastic block copolyester; and (B) 0.2 to 10% by weight based on the weight of the polyester elastomer (A), of anti-cohesive agent mixed into the polyester elastomer (A) and comprising:

(a) a first component comprising at least one sulfonic acid metal salt of the formula (1):

$$R^1—SO_3M \quad (1)$$

wherein $R^1$ represents a member selected from the group consisting of saturated and unsaturated hydrocarbon groups having 5 to 25 carbon atoms, and M represents an alkali metal atom, and (b) a second component comprising at least one compound selected from group consisting of the formulae (2) to (6):

$$R^2—X_p—CH_2CH_2OH \quad (2)$$

$$R^3—COO—CH_2CH(OH)CH_2O \quad (3)$$

$$R_4—COO—(CH_2CH_2O)_m—H \quad (4)$$

$$R^5—O—(CH_2CH_2OH \quad (5)$$

and $$R^6—CONHCH_2CH_2NHCO—R^7 \quad (6)$$

wherein $R^2$ to $R^7$ respectively and independently from each other represent saturated or unsaturated aliphatic hydrocarbon group having 5 to 25 carbon atoms, X represents a member selected from the group consisting of a —CONY-group and a $$-\overset{|}{N}(CH_2CH_2OH)$$

group, Y represents a member selected from the group consisting of a hydrogen atom and —$CH_2CH_2OH$ groups, p represents a numeral of 0 to 1, and m and n respectively and independently from each other represent an integer of 5 to 50.

2. The elastic polyester fibers as claimed in claim 1, wherein the polyester elastomer comprises at least one polyetherester block copolymer of a dicarboxylic acid component comprising terephthalic acid, with a glycol component comprising 1,4-butanediol and a poly(alkyleneoxide) glycol component having an average molecular weight of 400 to 4,000.

3. The elastic polyester fibers as claimed in claim 1, wherein the sulfonic acid alkali metal salt of the formula (1) is selected from the group consisting of a mixture of sodium alkylsulfonates having 15 carbon atoms in average, sodium decanesulfonate, sodium laurylsulfonate, disodium decanedisulfonate, sodium dodecylbenzenesulfonate and potassium dibutylnaphthalenesulfonate.

4. The elastic polyester fibers as claimed in claim 1, wherein the compounds of the formulae (2) to (6) are selected from the group consisting of lauroylmonoethanolamide, stearoylmonoethanolamide, lauroyldiethanolamide, stearoyldiethanolamide, lauryldiethanolamine, stearyldiethanolamine, stearylalcohol, glycerol monostearate, polyethyleneglycol monostearate, polyethyleneglycol monostearylether, and ethylene-bis-stearoylamide.

5. The elastic polyester fibers as claimed in claim 1, wherein in the anti-cohesive agent, the first component (a) and the second component (b) are present in a mixing weight ratio of 95/5 to 50/50.

6. An elastic polyester fiber article comprising a plurality of the elastic polyester fibers as claimed in claim 1.

7. The elastic polyester fiber article as claimed in claim 6, being selected from stretchable nonwoven fabrics, packing fiber masses and stretchable woven and knitted fabrics.

8. The elastic polyester fiber article as claimed in claim 7, comprising stretchable nonwoven fabrics of wet-laid nonwoven fabrics formed from the elastic polyester fibers in the form of staple fibers having a thickness of 0.11 to 22.22 dtex (0.1 to 20.0 denier) and a length of 2 to 25 mm.

9. The elastic polyester fiber article as claimed in claim 8, wherein the elastic polyester staple fibers have a thermal dry shrinkage of 40% or less at a temperature of 120° C.

10. The elastic polyester fiber article as claimed in claim 8, wherein the elastic polyester staple fibers are individually coated with 0.1 to 2.0% by weight, based on the weight of the staple fibers, of a water-dispersible polyester resin.

11. The elastic polyester fiber article as claimed in claim 7, comprising stretchable nonwoven fabrics of dry-laid nonwoven fabrics formed from the elastic polyester fibers in the form of staple fibers having a thickness of 0.11 to 222.22 dtex and a length of 30 to 200 mm.

12. The elastic polyester fiber article as claimed in clam 7, comprising a packing fiber mass or a stretchable woven or knitted fabric formed from the elastic polyester fibers in the form of staple fibers having a thickness of 0.11 to 222.22 dtex and a length of 30 to 200 mm.

13. The elastic polyester fiber article as claimed in claim 7, comprising stretchable nonwoven fabrics formed from the elastic polyester fibers in the form of continuous filaments having a thickness of 1.11 to 11.1 dtex.

14. An elastic polyester fiber produced by mixing (A) and (B), wherein (A) comprises a polyester elastomer which comprises at least one member selected from elastic block copolyesters comprising (i) hard segments derived from at least one member selected from the group consisting of polyethelene terephthalate, polybutylene terephthalate, poly-1,4-cyclohexanedimethylene terephthalate, polyethylene naphthalate, and polybutylene naphthalate, and (ii) soft segments derived from at least one member selected from the group consisting of aliphatic polyethers, aliphatic polyesters and aromatic polyesters having a low melting temperature and/or substantially no crystallizability, the soft segments (ii) being present in an amount of 30 to 80% by weight based on the weight of the elastic block copolyester; and (B) 0.2 to 10% by weight based on the weight of the polyester elastomer (A), of anti-cohesive agent mixed into the polyester elastomer (A) and comprising:

(a) a first component comprising at least one sulfonic acid metal salt of the formula (1):

$$R^1—S_3M \quad (1)$$

wherein $R^1$ represents a member selected from the group consisting of saturated and unsaturated hydrocarbon groups having 5 to 25 carbon atoms, and M represents an alkali metal atom, and (b) a second component comprising at least one compound selected from group consisting of the formulae (2) to (6):

$$R^2—X_p—CH_2CH_2OH \quad (2)$$

$$R^3—COO—CH_2CH(OH)CH_2O \quad (3)$$

$$R_4—COO—(CH_2CH_2O)_m—H \quad (4)$$

$$R^5—O—(CH_2CH_2O)_n—H \quad (5)$$

and $$R^6—CONHCH_2CH_2NHCO—R^7 \quad (6)$$

wherein $R^2$ to $R^7$ respectively and independently from each other represent saturated or unsaturated aliphatic hydrocarbon group having 5 to 25 carbon atoms, X represents a member selected from the group consisting of a —CONY-group and a $$-\overset{|}{N}(CH_2CH_2OH)$$

group, Y represents a member selected from the group consisting of a hydrogen atom and —$CH_2CH_2OH$ groups, p represents a numeral of 0 to 1, and m and n respectively and independently from each other represent an integer of 5 to 50.

15. A fiber according to claim 14, produced by mixing (a) and (b) to form (B), and then mixing (B) with (A).

* * * * *